US011857037B2

(12) United States Patent
Barnard et al.

(10) Patent No.: US 11,857,037 B2
(45) Date of Patent: Jan. 2, 2024

(54) MINIATURIZED COUPLINGS FOR JEWELRY COMPONENTS

(71) Applicant: Next Space Inc., Dallas, TX (US)

(72) Inventors: Timothy Barnard, Austin, TX (US); Dillon Chen, Dallas, TX (US)

(73) Assignee: NEXT SPACE INC., Dallas, TX (US)

( * ) Notice: Subject to any disclaimer, the term of this patent is extended or adjusted under 35 U.S.C. 154(b) by 203 days.

(21) Appl. No.: 17/324,153

(22) Filed: May 19, 2021

(65) Prior Publication Data

US 2021/0361037 A1 Nov. 25, 2021

Related U.S. Application Data

(60) Provisional application No. 63/027,756, filed on May 20, 2020.

(51) Int. Cl.

| | |
|---|---|
| ***A44C 5/08*** | (2006.01) |
| ***A44C 5/20*** | (2006.01) |
| ***A44C 13/00*** | (2006.01) |

(52) U.S. Cl.

CPC ..... *A44C 5/08* (2013.01); *A44C 13/00* (2013.01)

(58) Field of Classification Search

CPC ..... A44C 5/20; A44C 5/2028; A44C 5/2061; A44C 5/2052; A44C 5/08; A44C 13/00

See application file for complete search history.

(56) References Cited

U.S. PATENT DOCUMENTS 2,598,597 A * 5/1952 Philippe ..... A44C 5/20 267/71

2,629,156 A * 2/1953 Kamens ..... A44C 5/2052 24/657

(Continued)

FOREIGN PATENT DOCUMENTS

CH 676073 A * 12/1990 ..... A44C 5/2052

FR 1 409 848 A 9/1965

(Continued)

OTHER PUBLICATIONS

International Search Report and Written Opinion dated Sep. 14, 2021 in corresponding PCT International Application No. PCT/US2021/033061.

(Continued)

*Primary Examiner* — Jack W Lavinder

(74) *Attorney, Agent, or Firm* — OSTROLENK FABER LLP

(57) ABSTRACT

A miniaturized coupling for jewelry includes a male coupling and a female coupling, each of which is millimeter-sized or sub-millimeter-sized and each of which is attached to or suited to be attached to a respective jewelry component. The male coupling has a locking member configured to be inserted into the female coupling through an opening into an interior of the female coupling. A resiliently-biased, snap connector located in the interior of the female coupling, so constructed that when the locking member is inserted into the female coupling it initially moves and then is retained by the snap connector. An actuating pin in the female coupling is configured to move the snap connector to release the locking member and thereby disengage the male and female couplings from each other. The actuating pin has an outer surface accessible at an outer surface of the female coupling.

33 Claims, 23 Drawing Sheets

(56) References Cited

U.S. PATENT DOCUMENTS

| | | | | | |
|---|---|---|---|---|---|
| 4,310,953 | A * | 1/1982 | Nanasi | A44C 5/2052 | 24/656 |
| 4,374,449 | A * | 2/1983 | Stephenson | A44B 11/2515 | 24/656 |
| 5,010,630 | A * | 4/1991 | Mickelson | A44C 5/2052 | 24/647 |
| 6,145,171 | A * | 11/2000 | Hoshino | A44C 5/2052 | 24/658 |
| 6,484,376 | B1 * | 11/2002 | Khatchadourian | A44C 5/2052 | 24/616 |
| 7,082,651 | B2 * | 8/2006 | Ninomiya | A44C 5/209 | 63/35 |
| 7,322,076 | B2 * | 1/2008 | Ninomiya | A44C 5/2052 | 24/658 |
| 7,980,095 | B1 * | 7/2011 | Masterson | A44C 11/002 | 63/3.1 |
| 2015/0047156 | A1 | 2/2015 | Ninomiya | | |

FOREIGN PATENT DOCUMENTS

| | | | |
|---|---|---|---|
| JP | H03-284216 | A | 12/1991 |
| KR | 2008-0091545 | A | 10/2008 |

OTHER PUBLICATIONS

International Preliminary Report on Patentability and Written Opinion dated Dec. 1, 2022 in corresponding PCT International Application No. PCT/US2021/033061.

* cited by examiner

MINIATURIZED COUPLINGS FOR JEWELRY COMPONENTS

CROSS-REFERENCE TO RELATED APPLICATION

The present non-provisional patent application claims the benefit of and priority to U.S. Provisional Patent Application No. 63/027,756, filed May 20, 2020, by Timothy Barnard and Dillon Chen, and entitled "MINIATURIZED COUPLINGS FOR JEWELRY COMPONENTS," the entire contents of which are incorporated herein by reference.

BACKGROUND OF THE INVENTION

The present invention generally relates to miniaturized coupling mechanisms and, more particularly, to coupling mechanisms suitable for enabling almost invisible intercoupling and/or reversible interlocking of jewelry components associated with necklaces, charms, bracelets, rings, earrings, wristbands etc., in a manner that provides a more secure and single-step coupling mechanism and allows easy disassembly of the coupled jewelry components. The coupling mechanisms of the present invention may be adapted to serve as jewelry clasp mechanisms and/or as miniaturized coupling elements usable in fields other than jewelry.

The coupling devices and mechanisms described herein are intended in accordance with preferred implementations of the invention to serve as the central components behind the jewelry concept that the present applicant refers to by the name Myriad, which aims to provide creative and self-expressive individuals with a DIY (do it yourself) ability to create unique jewelry pieces that are assembled from different jewelry components such as chains, beads, strands and the like, the choices and the final products being limitless. At the same time, the easy disconnection of the coupling devices also enables using the same jewelry components over and over again in different combinations, even on a daily basis, to create jewelry assemblies for particular occasions, settings, individuals and cultures.

A function of a jewelry coupling and closure mechanisms and the like is not only to make initial contact between the ends of two jewelry components or to allow easy interchanging of charms, beads, strands and like functions, but also to ensure that during the lifetime use of the jewelry pieces, the coupling and closing mechanisms remain secure, easy to use and not prone to accidentally open owing to metal fatigue or wear, particularly when made of gold, which can result in expensive jewelry becoming lost.

Clasps and various closures and coupling are abundant in the jewelry field, including as evidenced in patent to the assignee of the present invention. But, prior art closures are generally more bulky and too visible for the purposes of the present invention.

SUMMARY OF THE INVENTION

Accordingly, it is an object of the present invention to provide jewelry coupling mechanisms and devices that avoid many of the drawbacks of the prior art.

It is another object of the present invention to provide jewelry coupling mechanisms and devices that are very small, so as not to substantially affect the aesthetic designs of the individual jewelry components being assembled.

It is yet another object of the present invention to provide jewelry coupling mechanisms and devices that are easy to use by lay persons, ornamentally compatible and highly reliable and far less likely to lose their functionality with repeated use of the coupling mechanism.

It is yet another object of the present invention to provide jewelry coupling mechanisms and devices that are sturdy and strong as standard jewelry, as well as being flexible, and having a nice touch and feel, including a tactile feel of the coupling, yet being capable of inexpensive and easy manufacturing.

The foregoing and other objects of the invention are realized in accordance with several preferred embodiments of the present invention that have been reduced to practice, as illustrated in the appended drawings.

In preferred embodiments, a miniaturized coupling for jewelry includes a male coupling and a female coupling, each of which is millimeter-sized or sub-millimeter-sized and each of which is attached to or suited to be attached to a respective jewelry component, the male coupling having a locking member configured to be inserted into the female coupling through an opening into an interior of the female coupling; a resiliently-biased, snap connector located in the interior of the female coupling, so constructed that when the locking member is inserted into the female coupling it initially moves and then is retained by the snap connector; and an actuating pin in the female coupling that is configured to move the snap connector to release the locking member and thereby disengage the male and female couplings from each other, the actuating pin having an outer surface accessible at an outer surface of the female coupling, said outer surface of said actuating pin being configured to be actuated to move the snap connector using either a releasing tool having a needle inserting tip or a human nail.

Preferably, the coupling comprises surface decorations and an overall shape that promotes the look and appearance of the coupling to blend into a corresponding look and appearance of the jewelry component. Upon mating of the male and female couplings the locking member is rendered virtually invisible. The coupling includes a spring that is engaged with the locking element, to push it out of the female coupling upon actuation of the actuating pin. The snap connector comprises an inclined surface that is engaged by the locking member when pushed into the interior of the female coupling, in a manner that causes the snap connector to move laterally relative to the locking member, enabling the locking member to move past the snap connector. The snap connector has a spring that biases the snap connector to resist moving laterally when the inclined surface is engaged by the locking member.

Preferably, the locking member comprises a pair of fingers, each with a respective distal end, in which distal ends are oriented toward each other, with a gap therebetween, said distal ends being configured to move past the snap connector and to become locked inside the female coupling. One or both of the male and female coupling has a cross sectional dimension of less than six millimeters, or even less than five millimeters. The outer surface of the actuating pin may be aligned with the outer surface of the female coupling. The actuating pin is movable in a direction into the interior of the female coupling. Alternatively, the actuating pin is movable in a direction generally parallel to the outer surface of the female coupling, toward or away from the opening. A safety latch may be included.

The pair of fingers of the male coupling define a space for the snap connector, the space being generally square or circle shaped. The inclined surface may have a frusto-conical shape. In an embodiment, the female coupling comprises an outer housing, a base partially accommodating therein the snap connecter inside the housing and a cover over the base.

Other features and advantages of the present invention will become apparent from the following description of the invention which refers to the accompanying drawings.

DETAILED DESCRIPTION OF EMBODIMENTS OF THE INVENTION

Figure 1:
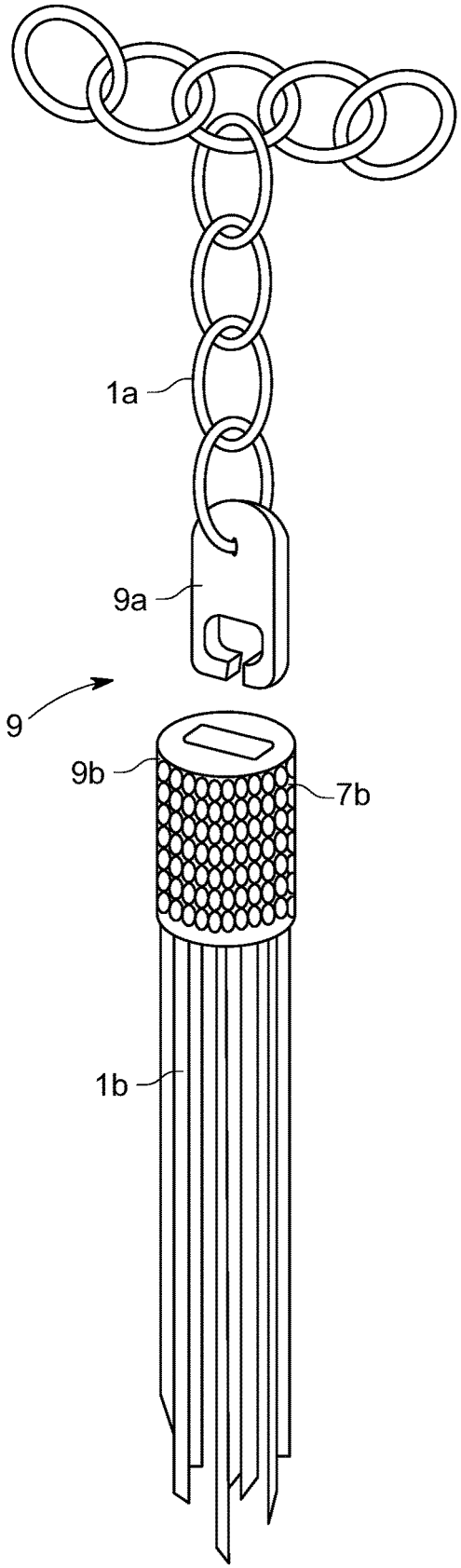
FIG. 1 is a conceptual perspective showing the jewelry coupling mechanism of the present invention.

With initial reference to FIG. 1, the conceptual underpinning of the present invention can be grasped at a glance. Thus, a first jewelry piece or component 1*a* can be snap connected to a second jewelry component 1*b*, using the millimeter-sized coupling 9. The coupling 9 comprises a male coupling 9*a* physically attached to the upper jewelry piece 1*a* and a female coupling 9*b* attached to the bottom jewelry 1*b*. As elaborated below, an actuating button (button 24 in FIG. 1*a*) at the rear of the female coupling 9*b* can be inwardly pressed to release the snap connection.

A jewelry piece 1*a* may have several couplings attached to it at different locations (not shown) to enable connecting to it multiple jewelry components. The outer surface 7*b* of the female coupling can have surface decorations formed thereon and its outer shape can be any shape desired including round, oval, triangular, literally any shape desired. Similarly with the male coupling 9*a*, while its bottom half portion needs the shape shown for effecting the coupling, its upper half can have a body shape that matches that of the female coupling, so that when the two coupling halves are interlocked the appearance is of a single contiguous piece. The material of the couplings can be any material whether plastic, metal, precious metal, combinations of materials and precious metal coated materials, without limitations.

Figure 1A:
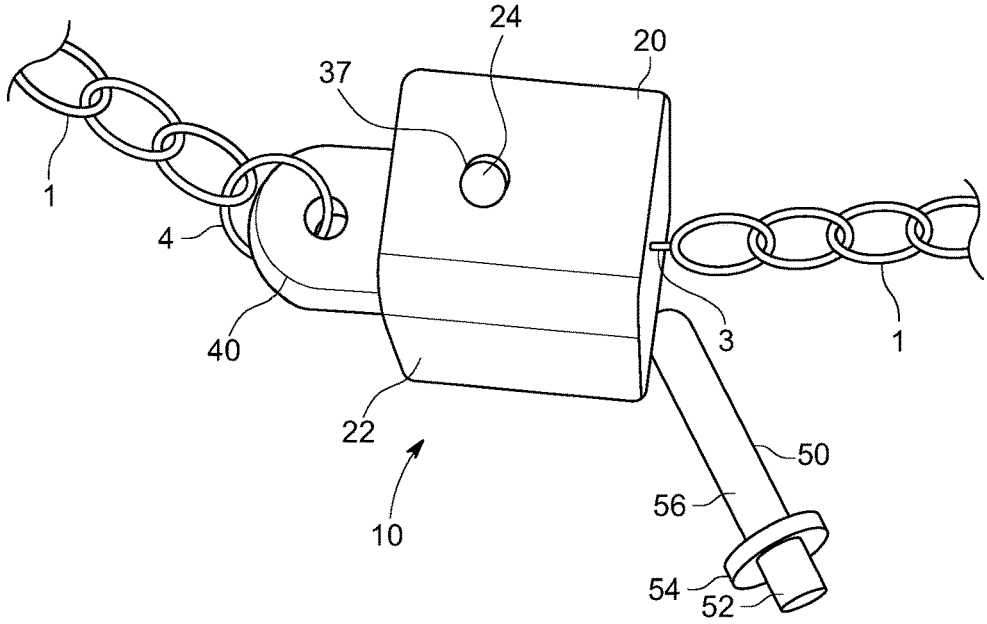
FIG. 1A is a diagram of an enlarged model of the coupling, in a locked state and showing features thereof, in accordance with a first embodiment of the invention.

Turning to specific embodiments, FIG. 1*a* shows a coupling 10 comprising a female coupling 20 to which is attached a jewelry strand 1 at point 3, with the male coupling 40 locked to the body 22 and having attached thereto the other end of the jewelry strand held with a ring 4. To release the male coupling 40, the invention provides a releasing tool 50 having a body 56 and an inserting distal end 52, which when pushed against the releasing pin 24 located in the opening 37 causes the male coupling 40 to become separated from the female coupling 20, as more fully explicated below. The stop band 54 on the tool 50 is located to control the depth of insertion of the tool 50 into the cavity 37. Preferably, at least 75% of the distal end 52 must be inserted to cause separation of the male and female couplings, thereby preventing accidental disengagement thereof, e.g. about 1 or 2 mm beyond the surface of the female coupling. In an embodiment, the outer edge of the actuating pin may extend just beyond (less than a millimeter) the outer surface of the female coupling, so that its location can be quickly determined by finger touching.

Figure 1B:
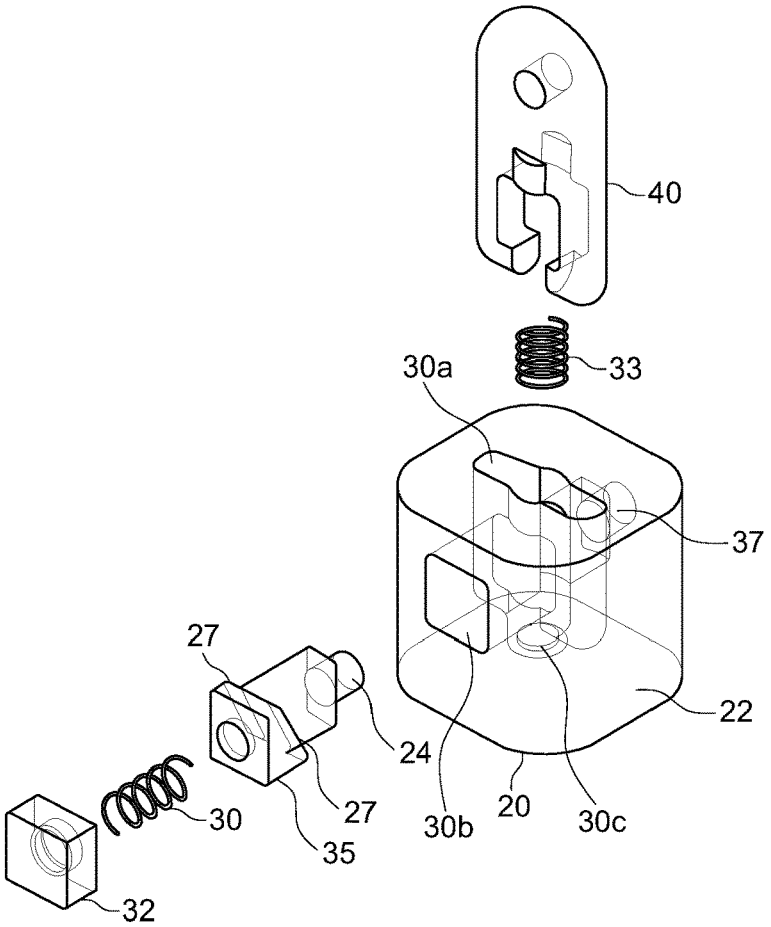
FIG. 1B is an exploded drawing of the components of FIG. 1A.
Figure 4:
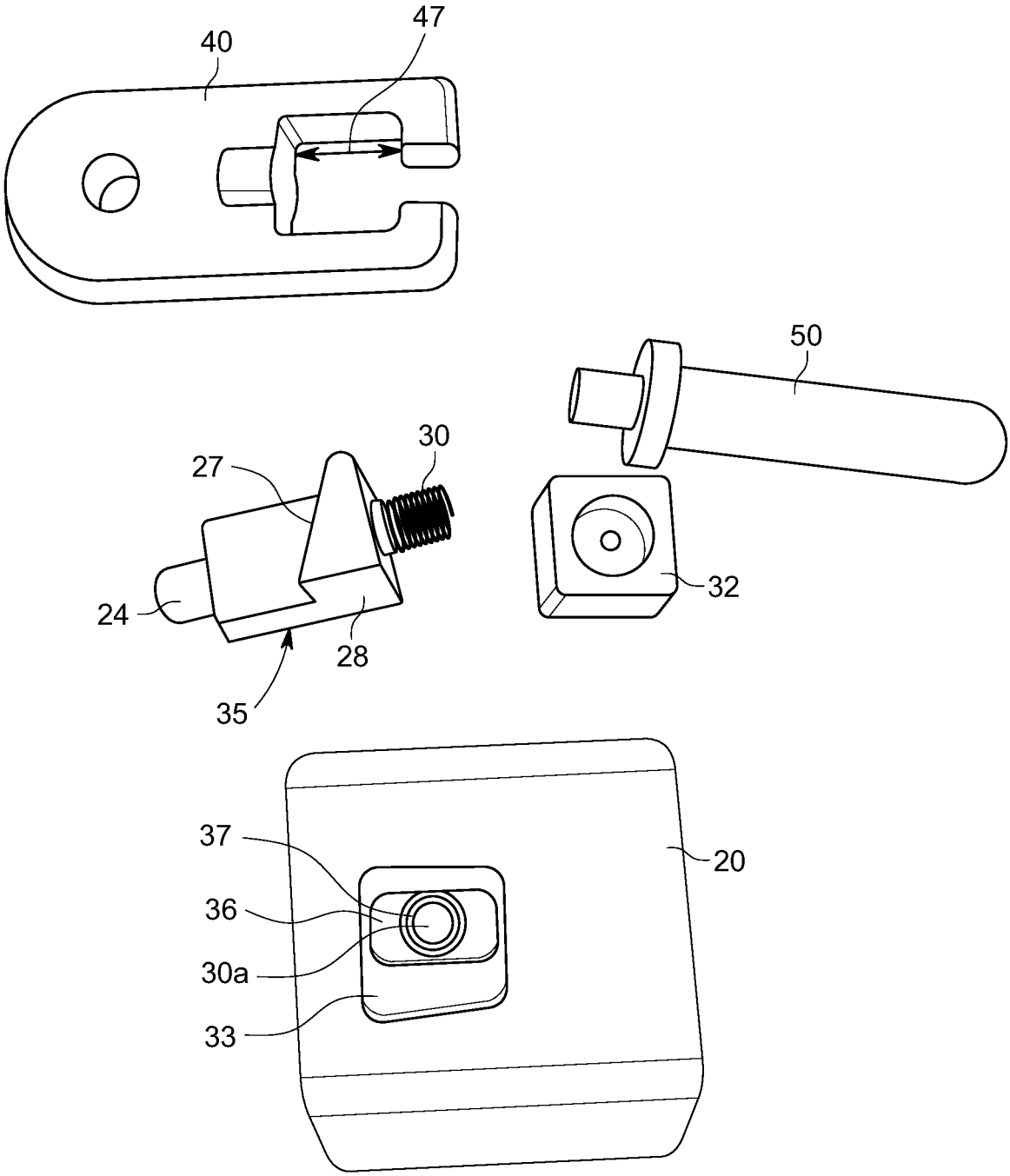
FIG. 4 shows further components of the first embodiment of the present invention.

FIGS. 1*b* and 4 show the internal functional components inside the female coupling 20, including the interior spaces inside the body 22 with a first top side opening 30*a* through which a first vertical spring 33 is dropped into a bottom cavity 30*c*. The interior space is also shaped for the insertion of the releasing tool 50. The side opening 30*b* is used during assembly to insert the sliding catch 35 whose forward distal end comprises the releasing button 24 which is fitted into the front cavity 37, with the horizontal spring 30 being closed inside by the end cap 32 which is glued or welded to lie flush with the outer surface of the body 22.

Figure 2:
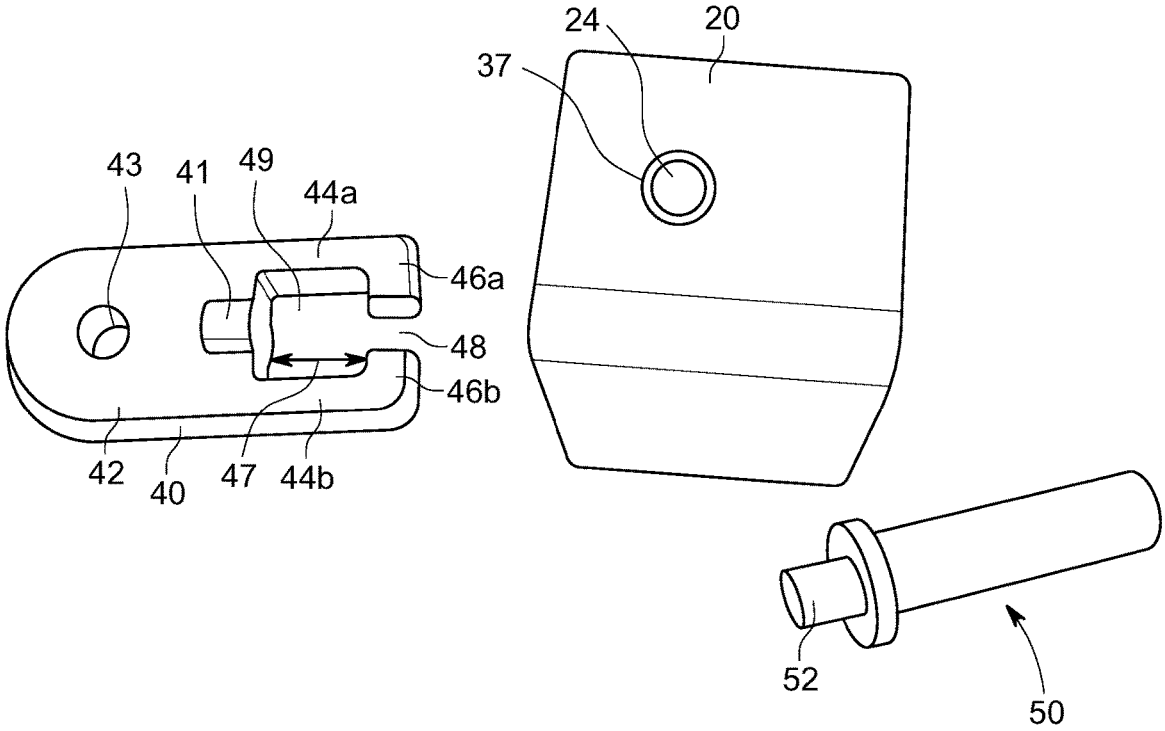
FIG. 2 is a diagram of an enlarged model of the coupling, in an unlocked state and showing features thereof, in accordance with the first embodiment of the invention.
Figure 3:
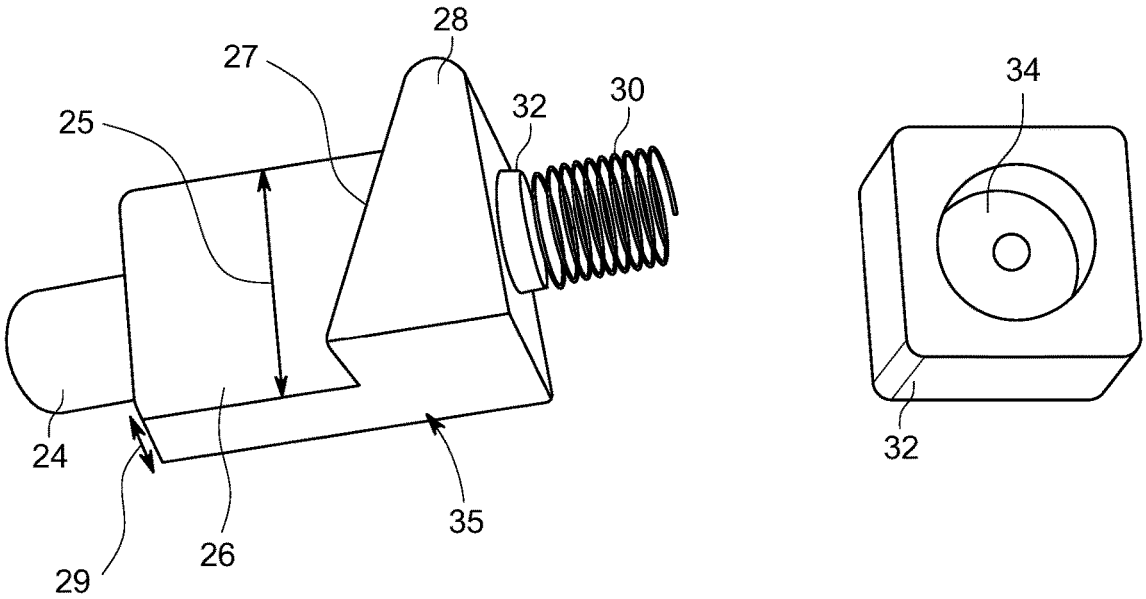
FIG. 3 shows components of the first embodiment of the present invention.

With reference to FIG. 3, the sliding catch 35 has a main body portion 26 with a height 25 and thickness 29 and right and left inclined sliding surfaces 27 located at a thickened portion 28, which also includes a protrusion 32 that holds the spring 30. The spring 30 is supported at its opposed end in the cavity 34 of the end cap 32. Also note the already mentioned release button 24. Thus assembled, the female coupling 20 (FIG. 2) is able to receive the male coupling 40, which male coupling has a body 42 with a shape partly defined by the pins 41, through its upper opening 30*a* into the female coupling. The male coupling is formed with fingers 44*a*, 44*b* that bend inwardly to form catches 46*a*, 46*b*, with a space therebetween 48 that is just slightly wider than the thickness dimension 29 (FIG. 3) of the sliding catch (or slider) 35. The fingers 44*a*, 44*b* define a rectangular inner space 49 whose extension in the direction of the arrow 47 just exceeds the dimension 25 of the slider 35.

Hence, when the male coupling 40 is pushed into the female coupling, the fingers 46*a*, 46*b* engage and bear against the sliding surfaces 27, pushing the slider 35 sideways against the biasing force of the spring 30, until these finger catches 46*a*, 46*b* slide past (below) the slider 35. Thereupon, the slider is free to slide back locking the fingers 46*a*, 46*b* below the slider. In this position, the male coupling is locked to the female coupling, thus securing the jewelry components respectively attached to the couplings firmly attached to each other, as seen for example in FIG. 1*a*. Releasing the lock is exceedingly simple and requires no more than a momentary insertion of the tip 52 of the releasing tool 50 into the cavity 37, which results in the slider 35 being pushed back, which immediately causes the finger end of the male coupling 40 to be pushed out by the spring 33 (FIG. 1*b*).

Figure 5:
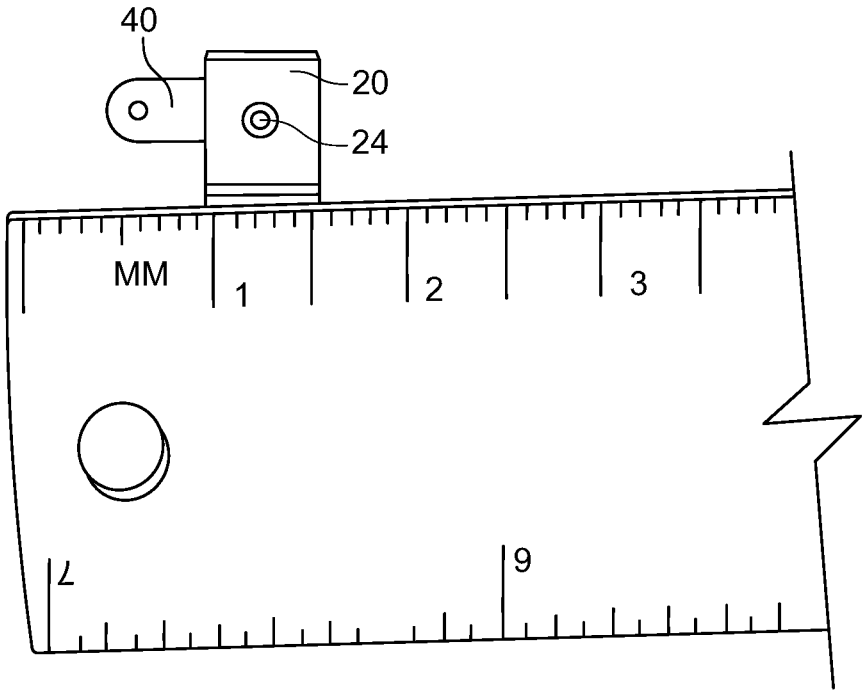
FIG. 5 is a photograph of the coupling reduced to practice according to the first embodiment of the present invention, in a locked state and indicating its exemplary size.
Figure 6:
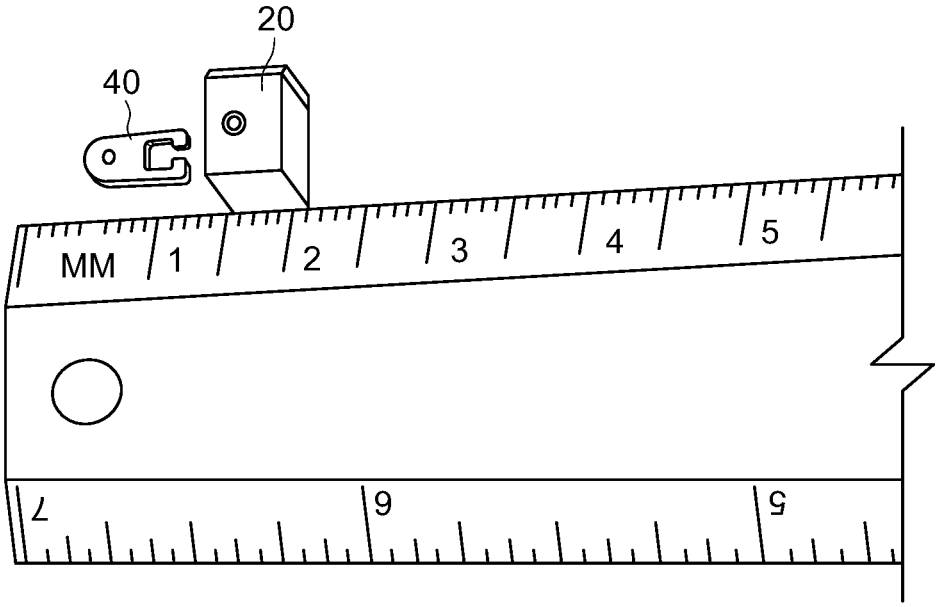
FIG. 6 is a photograph of the coupling of FIG. 5, in an unlocked state.

FIGS. 5 and 6 are photograph-like renditions of an actual coupling that is millimeter-sized and includes a female coupling 20 interlocked with a male coupling 40, rendered against a ruler to show their comparative dimensions. Although not shown, it is a trivial matter to render the female coupling large enough to allow providing therein multiple (spaced) openings and snap members for receiving and holding a corresponding number of female couplings.

A similar but differently implemented second embodiment of the present invention is explicated below by reference to FIGS. 7, 7*a* and 8-10. The male coupling 140 has a front opening 148 wider than the thickness 149 of the slider 135, whereby when it is pushed into the top opening, its inwardly bent fingers bear against the slanted surfaces 127 of the thickened portion 128, pushing the slider 135 to the right and then catching below the thickened portion 127 as previously described. In this embodiment, a pushing lever 124 protrudes upwards and can be engaged by a human finger or the like to be pushed to the right to release the male coupling 140.

Figure 7:
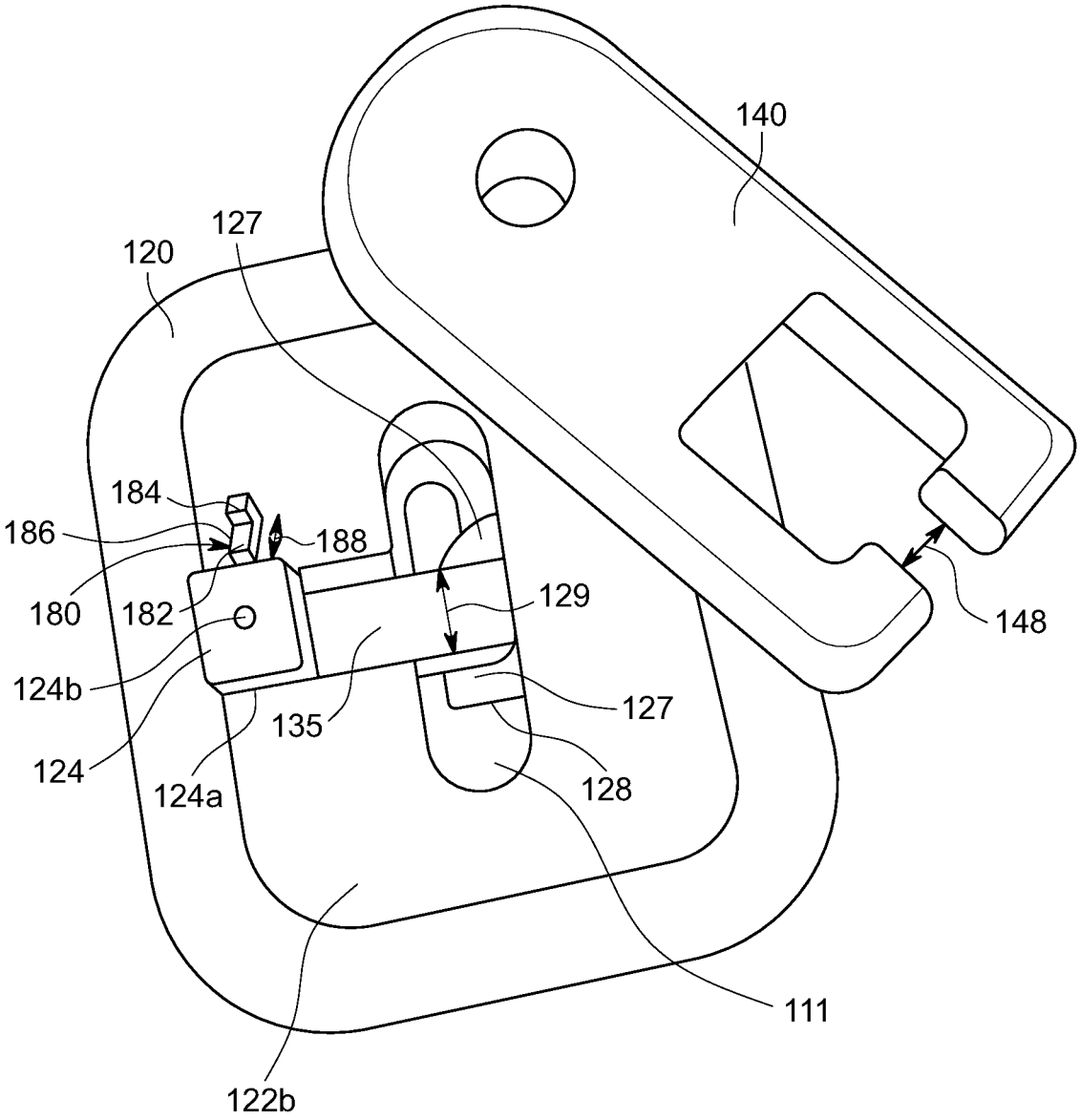
FIGS. 7, 7A, 8, 9 and 10 illustrate a coupling in accordance with a second embodiment of the present invention.
Figure 7A:
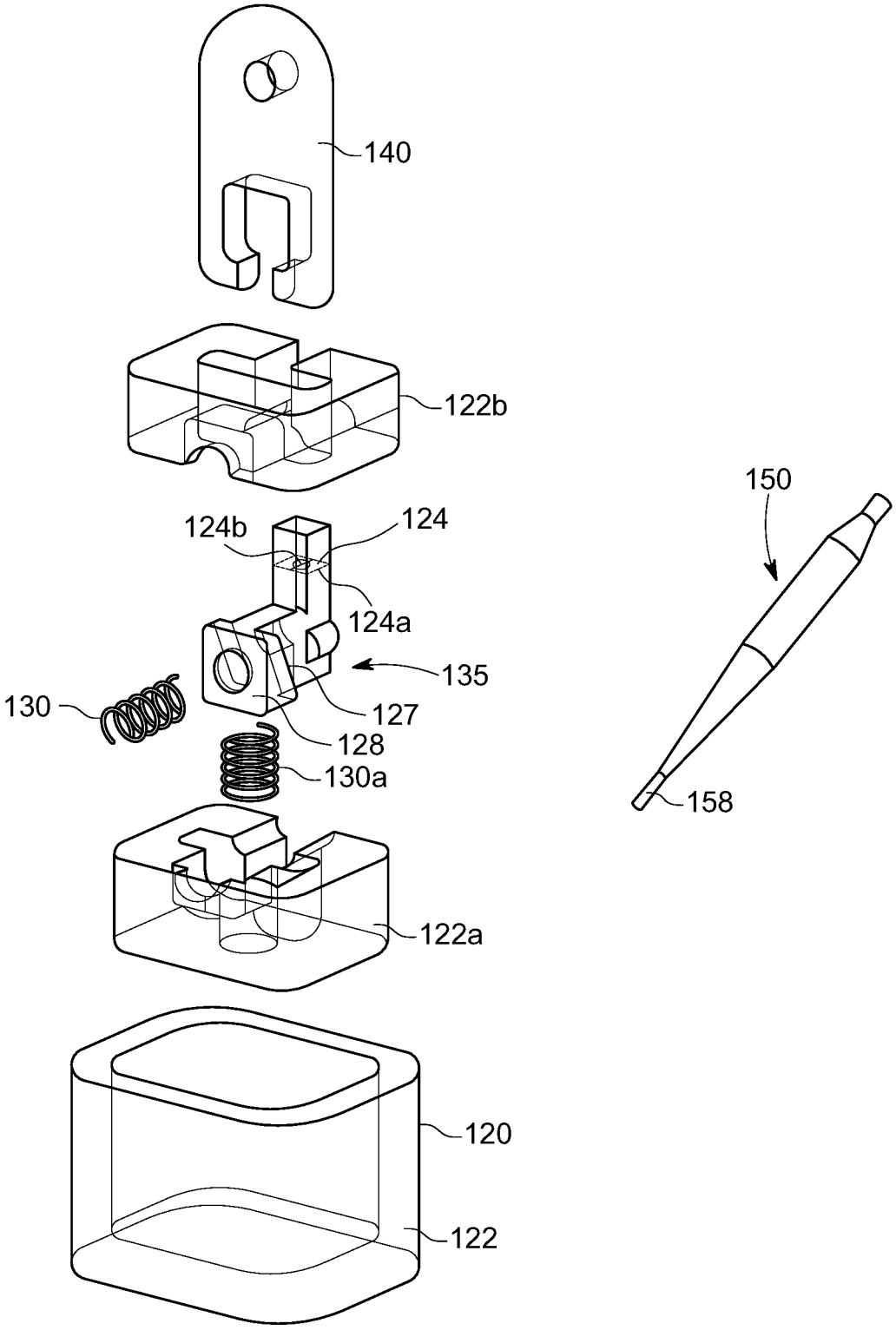
Figure 8:
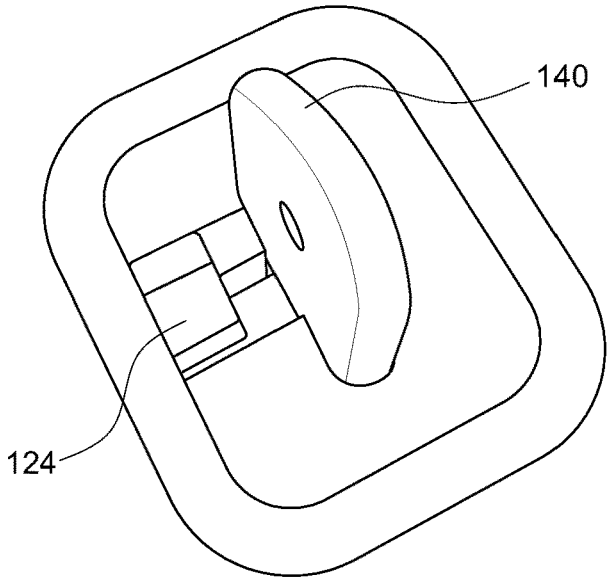
Figure 9:
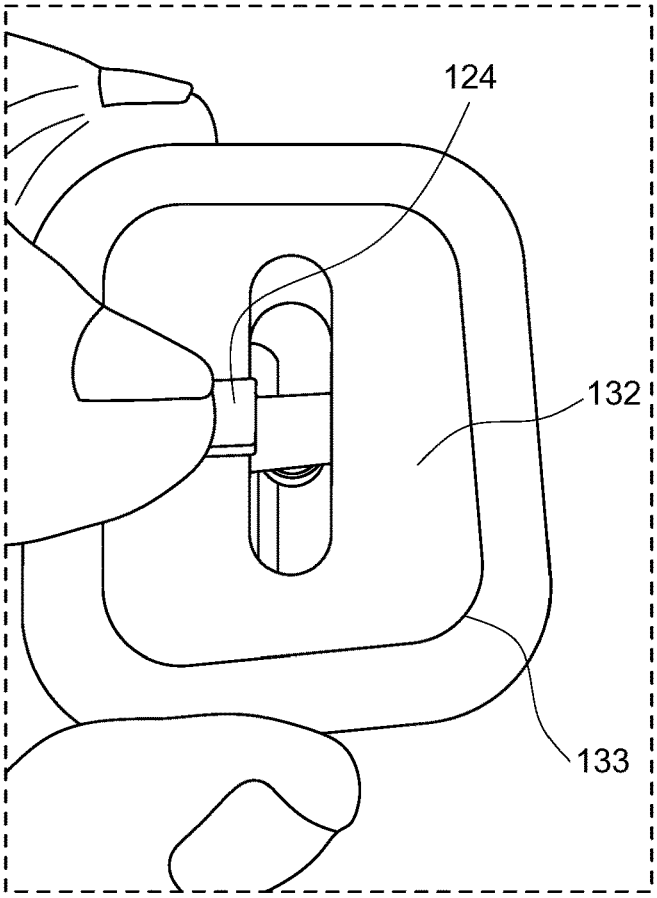
Figure 10:
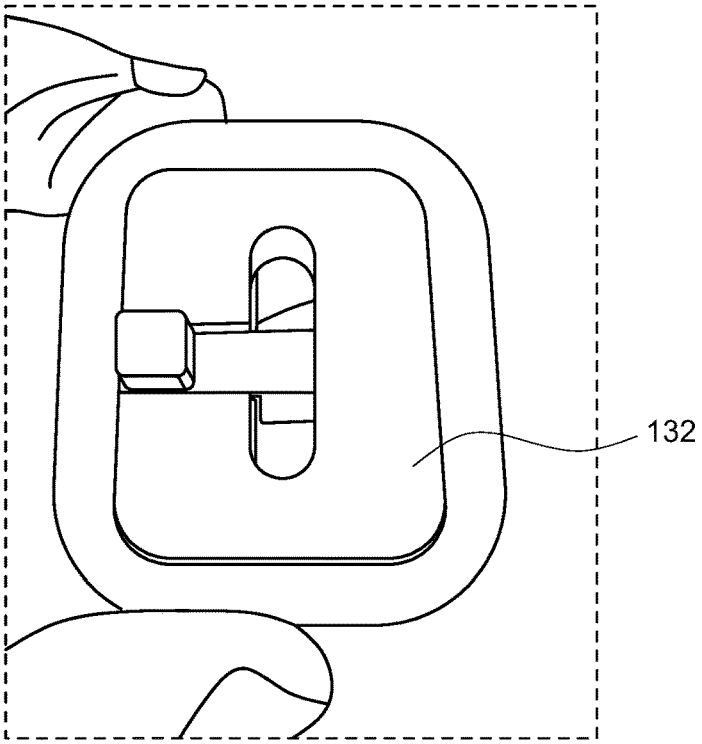
Figure 11:
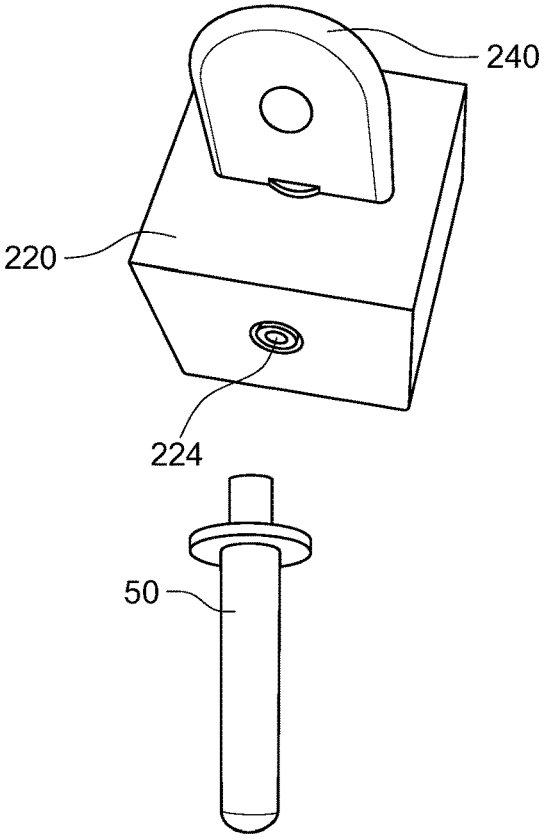
FIGS. 11, 12, 13, 14 and 15 illustrate a coupling in accordance with a third embodiment of the present invention.
Figure 12:
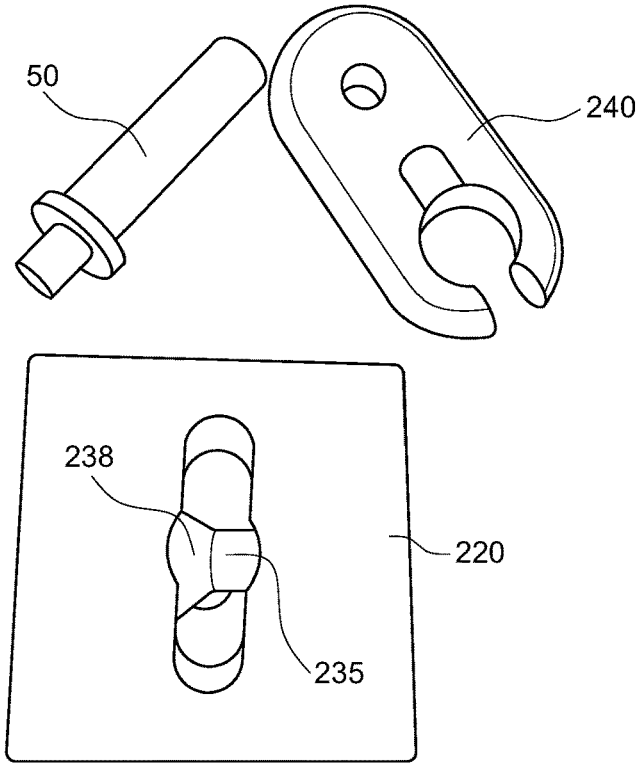

In the exploded view of FIG. 7*a* can be observed the hollow body 122 which accepts a base component 122*a* that provides the spaces for the lateral spring 130 and the vertical spring 130*a* that provide the same functions as the springs 30 and 30*a* of the first embodiment. It also provides the lateral sliding space for the slider 135 that includes the upright releasing bar 124. Thereby, and as shown in FIG. 8, releasing the male coupling requires just sliding the bar to the right which immediately causes the spring 130*a* to pop the male coupling 140 upwards, as the thickened portion 128 is pushed out of the way as shown in FIG. 9, which should be compared to FIG. 10.

In accordance with an alternative to the above modification of the second embodiment, as indicated by the dashed lines 124*a*, the height of the button 124 is made to be flush with the top surface of the cover 122*b* of the female coupling 120. Instead of engaging and sliding the slider 135 with a finger, the tool 150 (FIG. 7*a*) is provided with a narrowed diameter (pen-tip sized) needle end 158 that is capable of being inserted into the round crevice 124*b* located on the release button 124, to slide it to the position that will cause the male coupling to pop out of the coupling opening 111, disengaging the couplings from each other.

Figure 13:
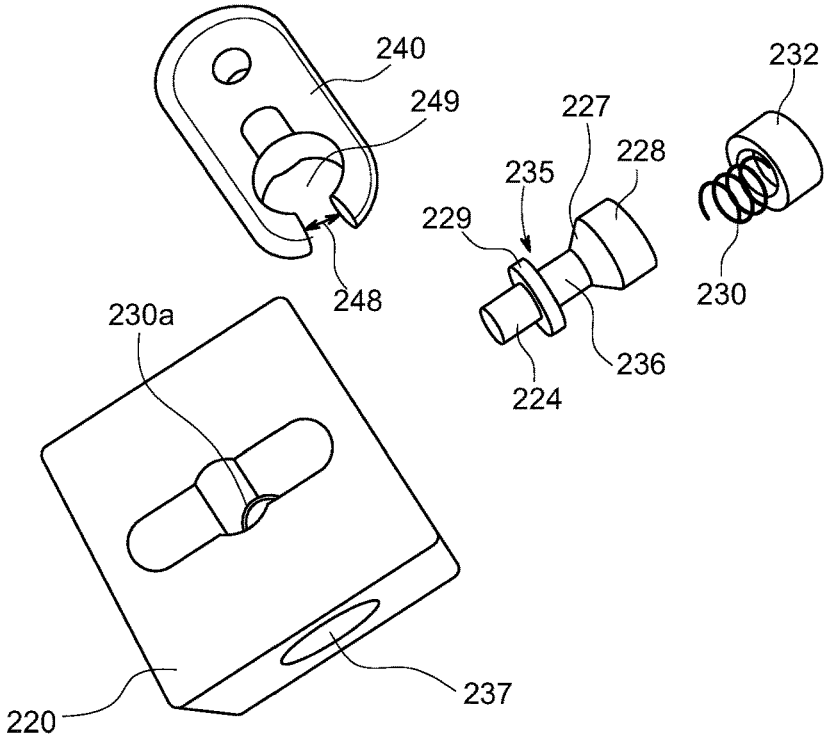

A third embodiment of the invention described with reference to FIGS. 11 through 15, includes the male coupling 240, a female coupling 220, a releasing button 224 and a releasing tool 50 usable to disengage the coupling elements from each other. As shown in FIG. 13, the male coupling 240 has a round opening 249 accessible via the opening 248 that is just wider than the diameter of the cylindrical center portion 236 of the slider 235. As in the prior embodiments, the slider 235 has a thickened portion 228 and a frusto-conical section 227. After the slider 235 is inserted into the interior space of the female coupling through the opening 237, its positioning therein is secured by the closing cylinder 232 which bears on the thickened portion 238 and biases it inwardly by the spring 230, similarly to the prior embodiments. Also, note the vertically oriented spring 230*a* inside the female coupling.

Figure 14:
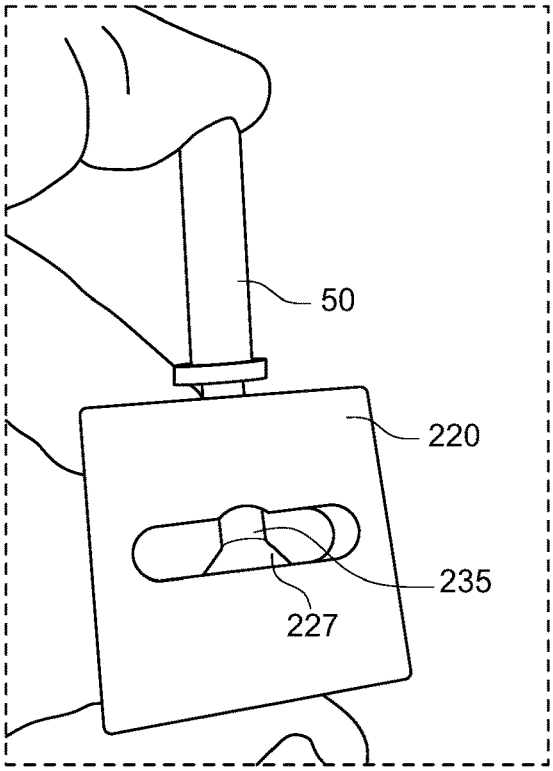
Figure 15:
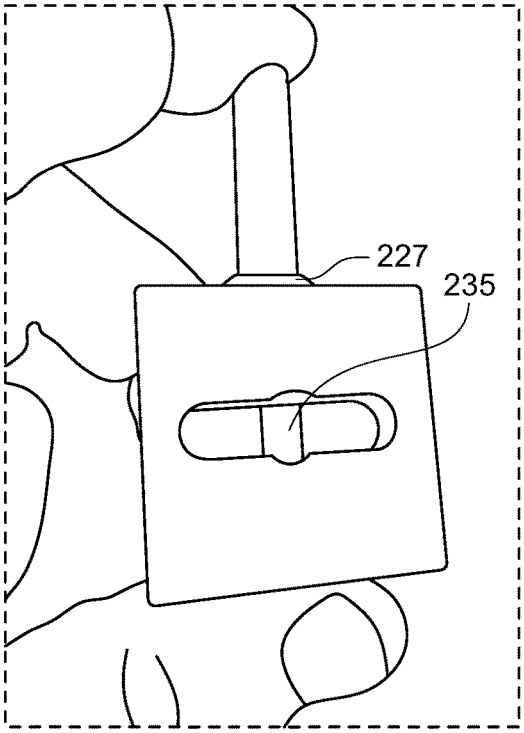

Owing to the spring 230 positioned at the thick side of the slider 235, it is possible to push the release button 224 to the left so that the thickened portion 238 is biased to locate itself in the opening into the female coupling 220. When the male coupling is pushed in, its fingers push the slider 235 laterally, until the fingers move past the slider, whereupon the slider reverts to its position, locking the male coupling. FIGS. 14 and 15 demonstrate the use of the releasing tool 50 to release the lock hold. Ideally, one can provide the slider 235 with a bottom surface that is flat, to prevent rotation of the slider 235 about its longitudinal axis, and to allow the catch fingers of the male coupling to rest against the flat bottom of the slider section 237. This will assure that the male coupling will not be pulled out by applying a hand force in a direction out of the female coupling.

A fourth embodiment of the invention is explicated below by reference to FIGS. 16, 16*a*, 16*b*, and 17-20. Structurally and functionally the fourth embodiment is similar to the second embodiment in that its components are inserted from the top side of the coupling that is eventually capped with a top cover 332. The female coupling 320 receives and locks therein the male coupling 340, which male coupling can be released with the releasing tool 50 by the insertion thereof into the opening 327 and pressing the release button 324.

Figure 16:
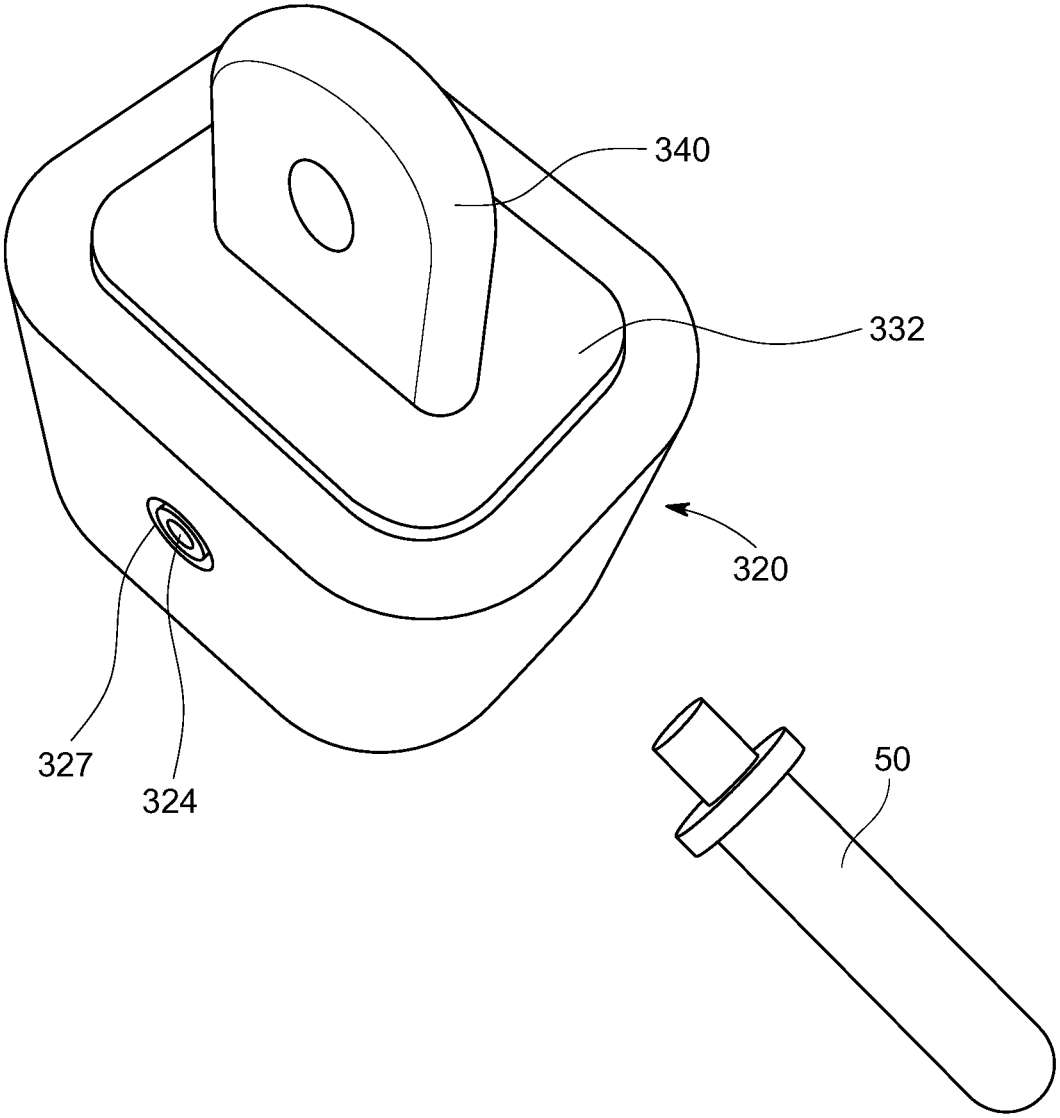
FIGS. 16, 16*a*, 16*b*, 17, 18, 19 and 20 illustrate a coupling in accordance with a fourth embodiment of the present invention.
Figure 16A:
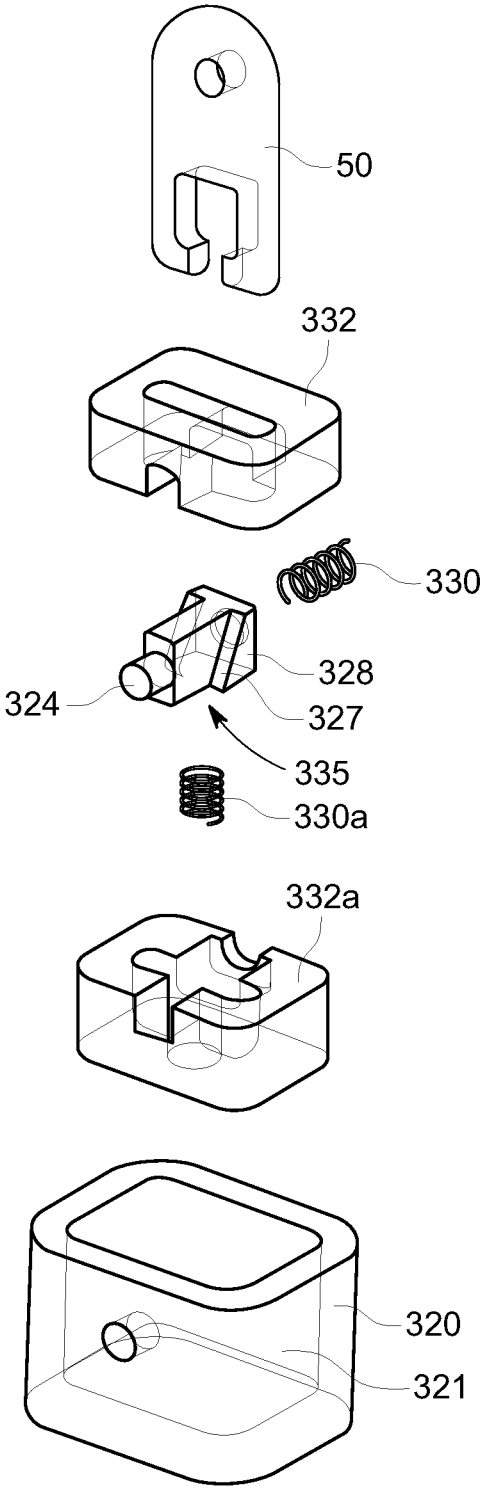
Figure 16B:
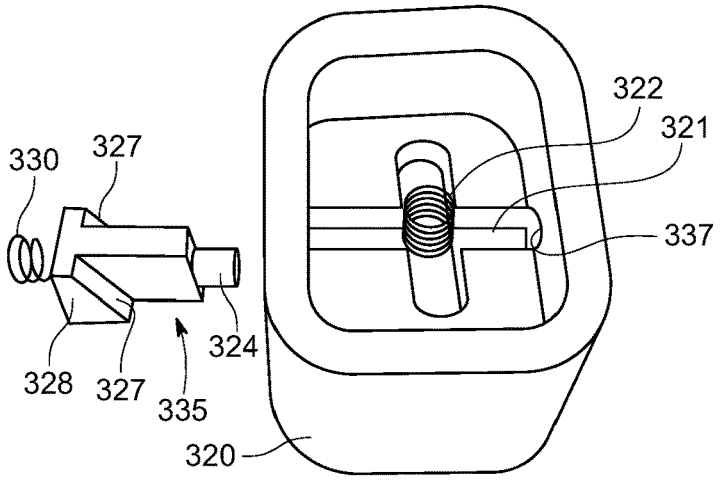
Figure 17:
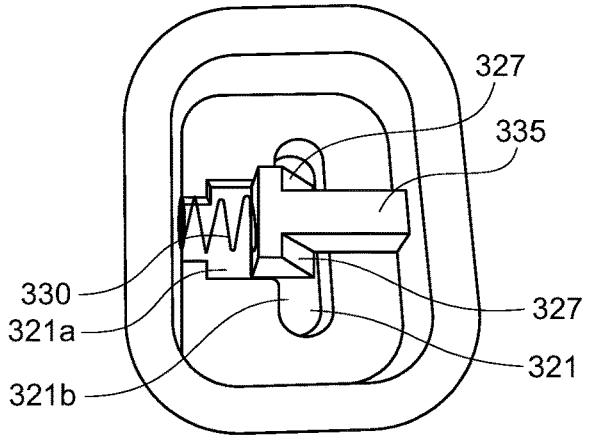
Figure 18:
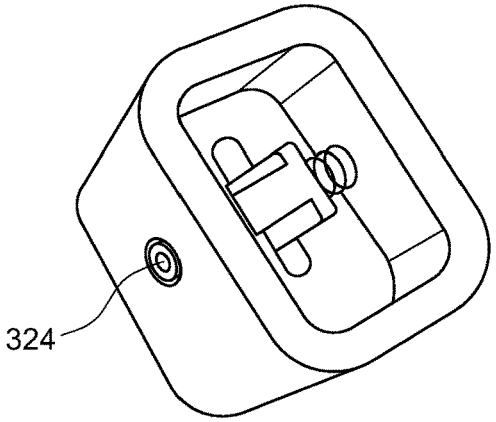
Figure 19:
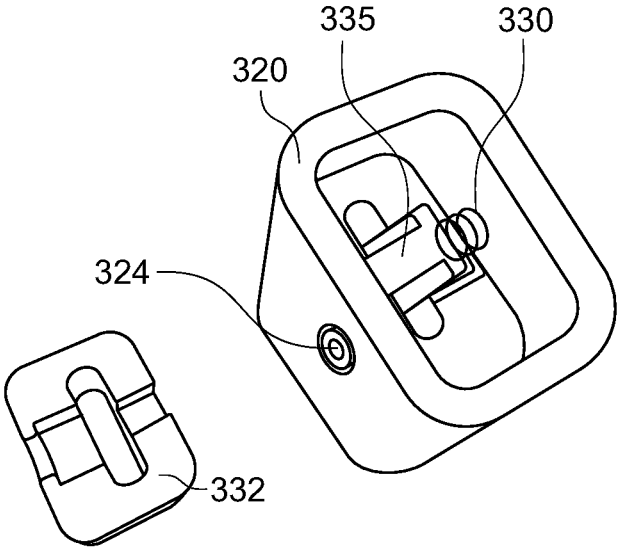
Figure 20:
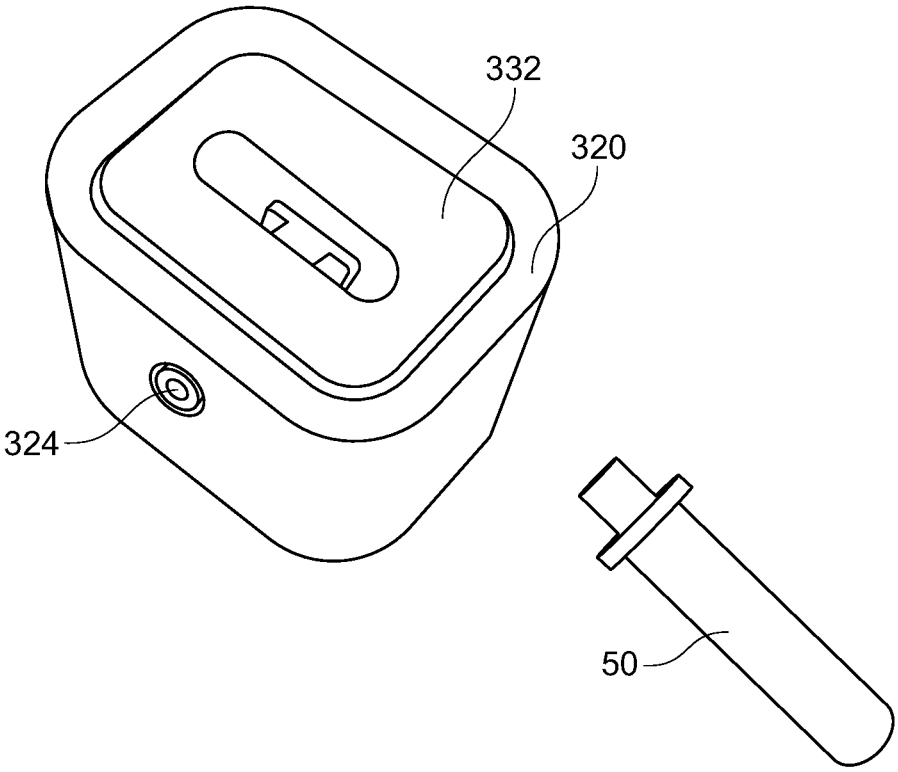

The exploded view of FIG. 16*a* shows the hollow body of the female coupling with a housing 320 that is sized to receive the base 322*a*, which has defined therein the space for the vertical spring 330*a*, the slider 335 and the lateral spring 330. The slider 335 is identical to some of the prior sliders in that it comprises the releasing button 324 and the thickened portion 328 that supports the sliding surfaces 327. The structural components are covered by the cover 332 and fitted into the hollow space 321. The male coupling 50 can now be inserted and locked within the female coupling 320. See FIG. 20.

Figure 21A:
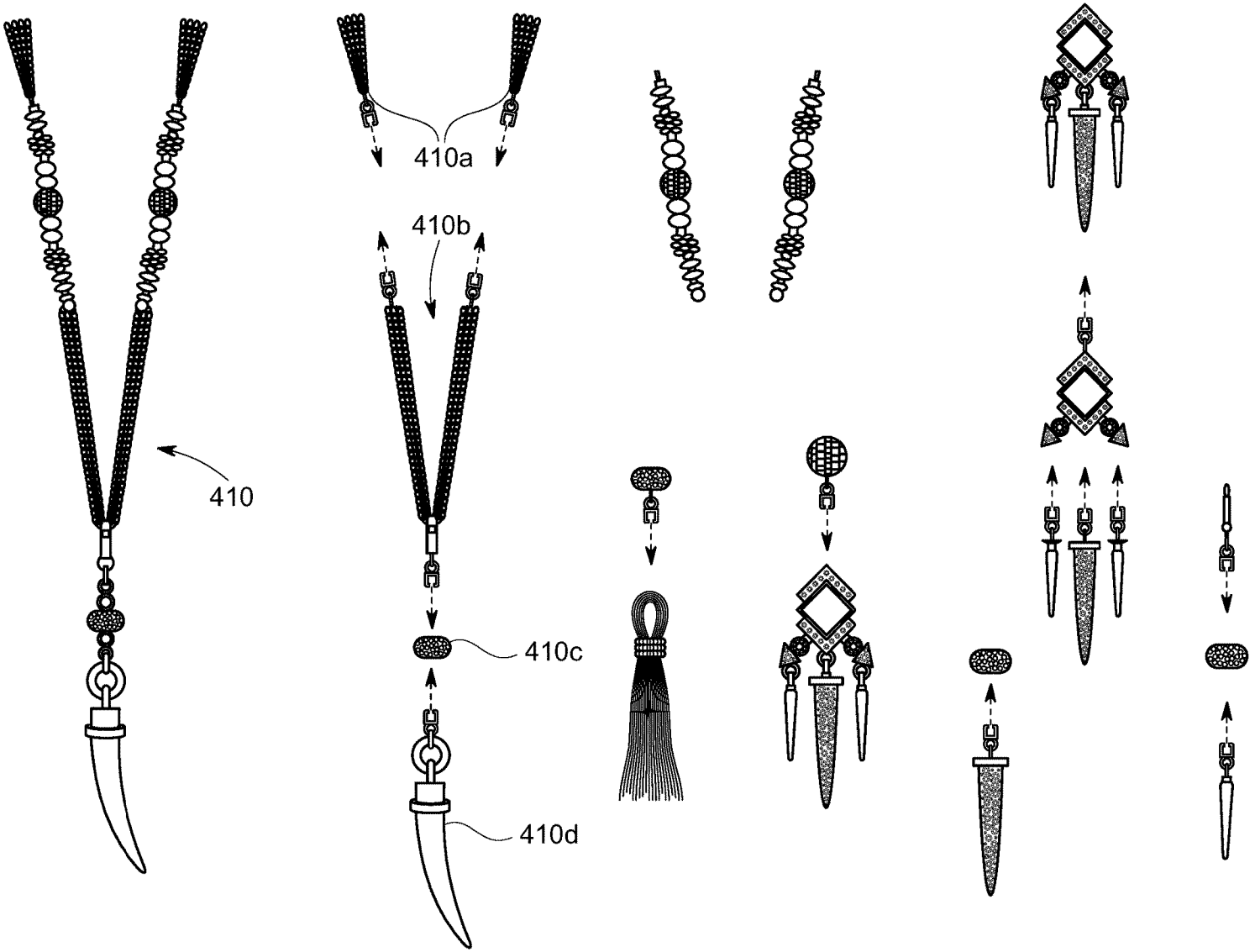
FIGS. 21A and 21B depict jewelry components that are suitable for being intercoupled to create DIY jewelry, using the couplings of the present invention.
Figure 21B:
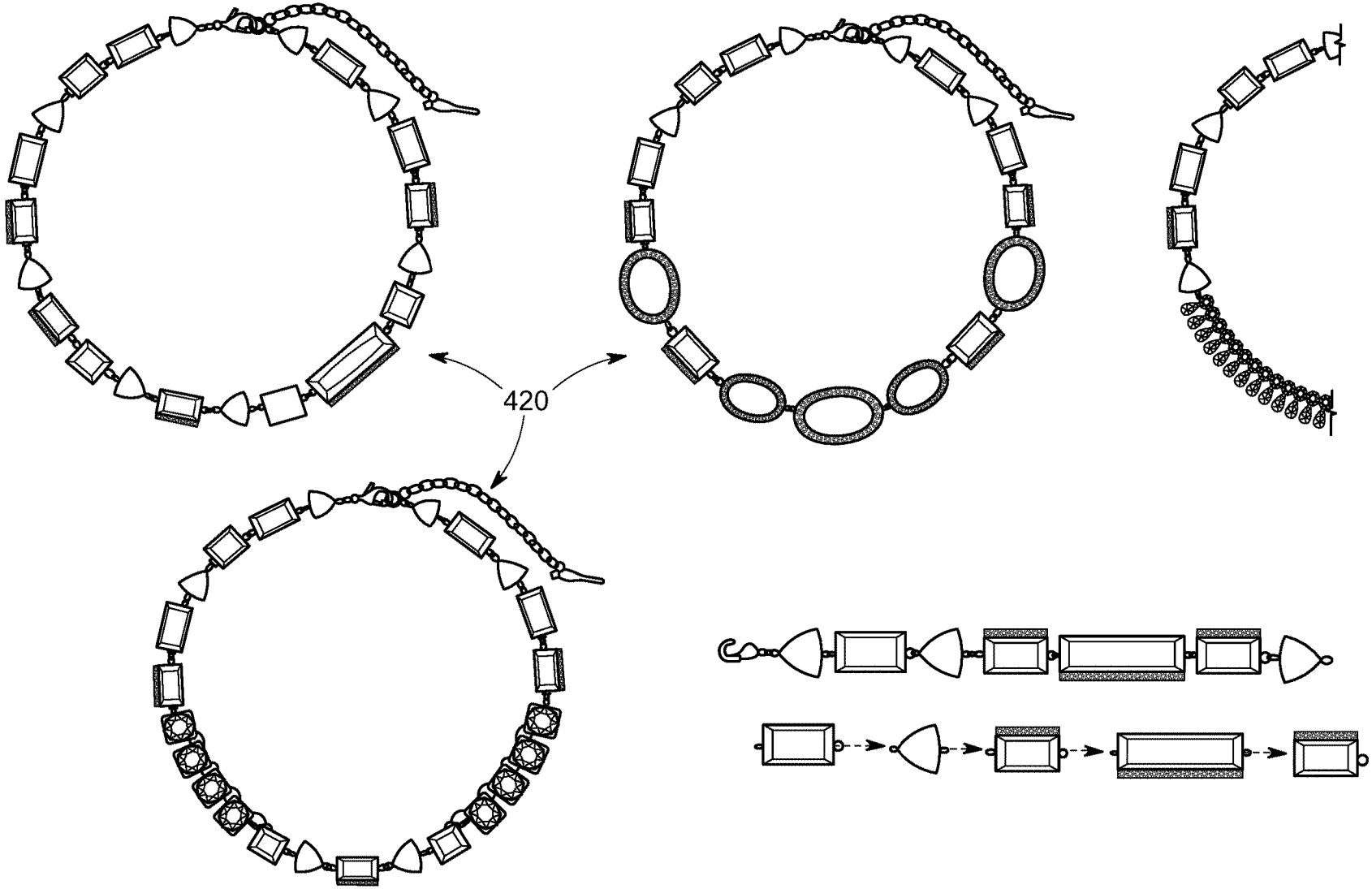

Referring now FIGS. 21A and 21B, one can see at a glance the many jewelry components 410*a*, 410*b*, that are assembled together to realize an assembled jewelry piece 410, utilizing the couplings of the present invention. See also the jewelry pieces 420 and 430 and so on throughout the FIGS. 21*a*-21*e*. Since the couplings are tiny, mm sized, and can have body shapes, metal types and finishes that are tailored to many different applications they can blend invisibly into the overall jewelry pieces and allow creative people tremendous latitude and flexibility in creating jewelry pieces for the moment, the occasion, the mood and style required. The concept of the invention can be used by professional designers to manufacture jewelry pieces from basic stock components and to re-use and re-purpose jewelry components. In a further conceptualized form of the invention, the individual jewelry components may be displayed on a computer monitor, with App being provided that allows customers the option of the computer combining various pieces together to obtain a final look and appearance of the jewelry. Customer who like how a jewelry assembly that they have visualized on a computer screen, can then place an order for all those jewelry components with just a computer click, thereafter receiving the components and assembling them at home.

Figure 22:
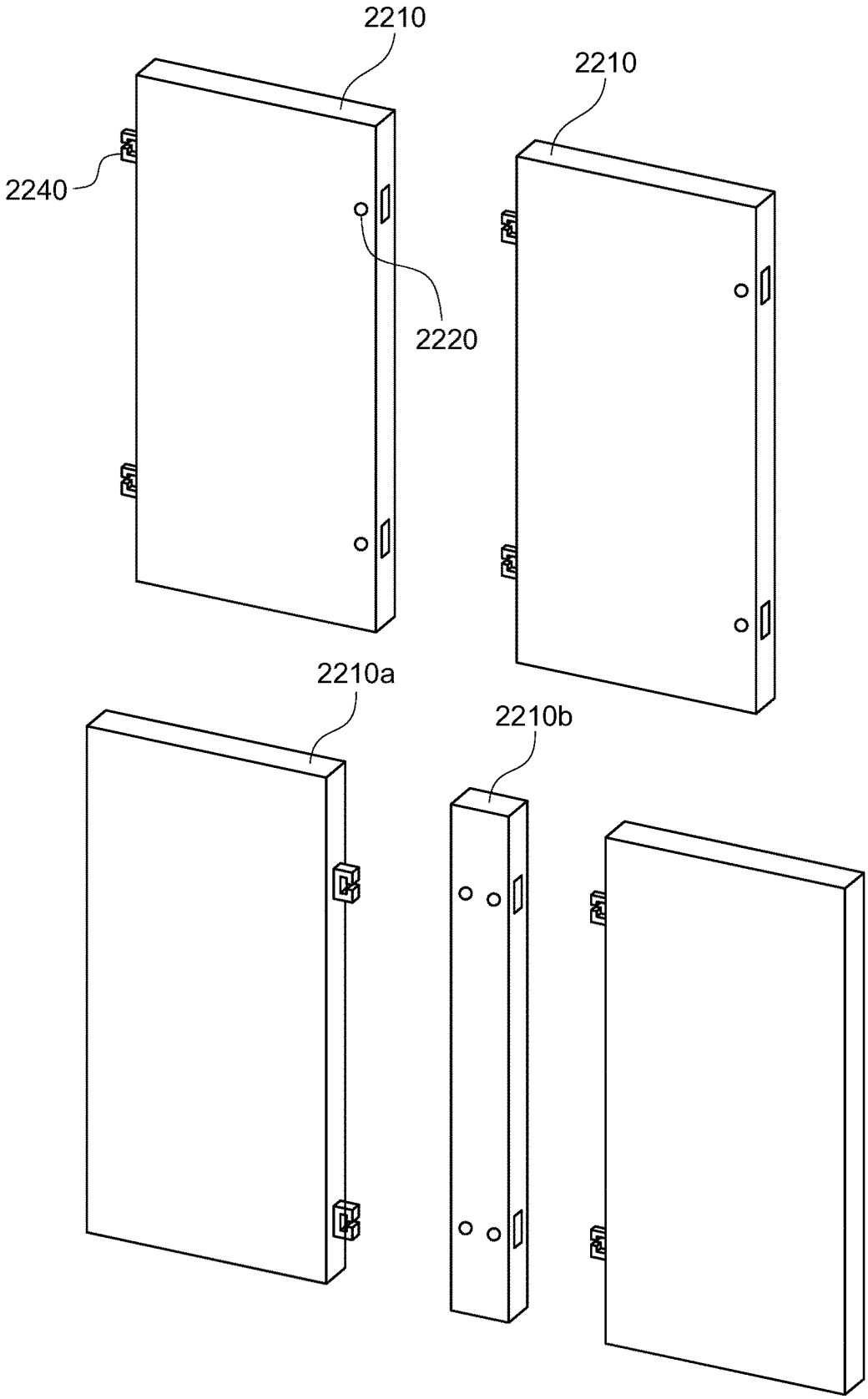
FIGS. 22, 23, 24, 25 and 26 illustrate the coupling concept of the present invention being applied in the context of paneling, chairs, tables, maritime anchors and eye wear, respectively.

The couplings utilizing the novel concepts of the present invention have been described above in relation to jewelry. However, many other applications are contemplated by the inventors herein. Thus, in FIG. 22 the paneling 2210 or 2210(*a*) comprise female couplings 2220 and male couplings 2240 at the shown locations in or on the paneling. In one embodiment each panel is provided with a pair (or more) of female couplings on one mating edge and male couplings on the opposed mating edge. In another embodiment, the larger panels are provided with only male couplings and a connecting panel 2210(*b*) has the female couplings built-in.

Preferably, the releasing pin for the female couplings can have a screw slot and can be threadedly turned to lock or unlock the male coupling.

Figure 23:
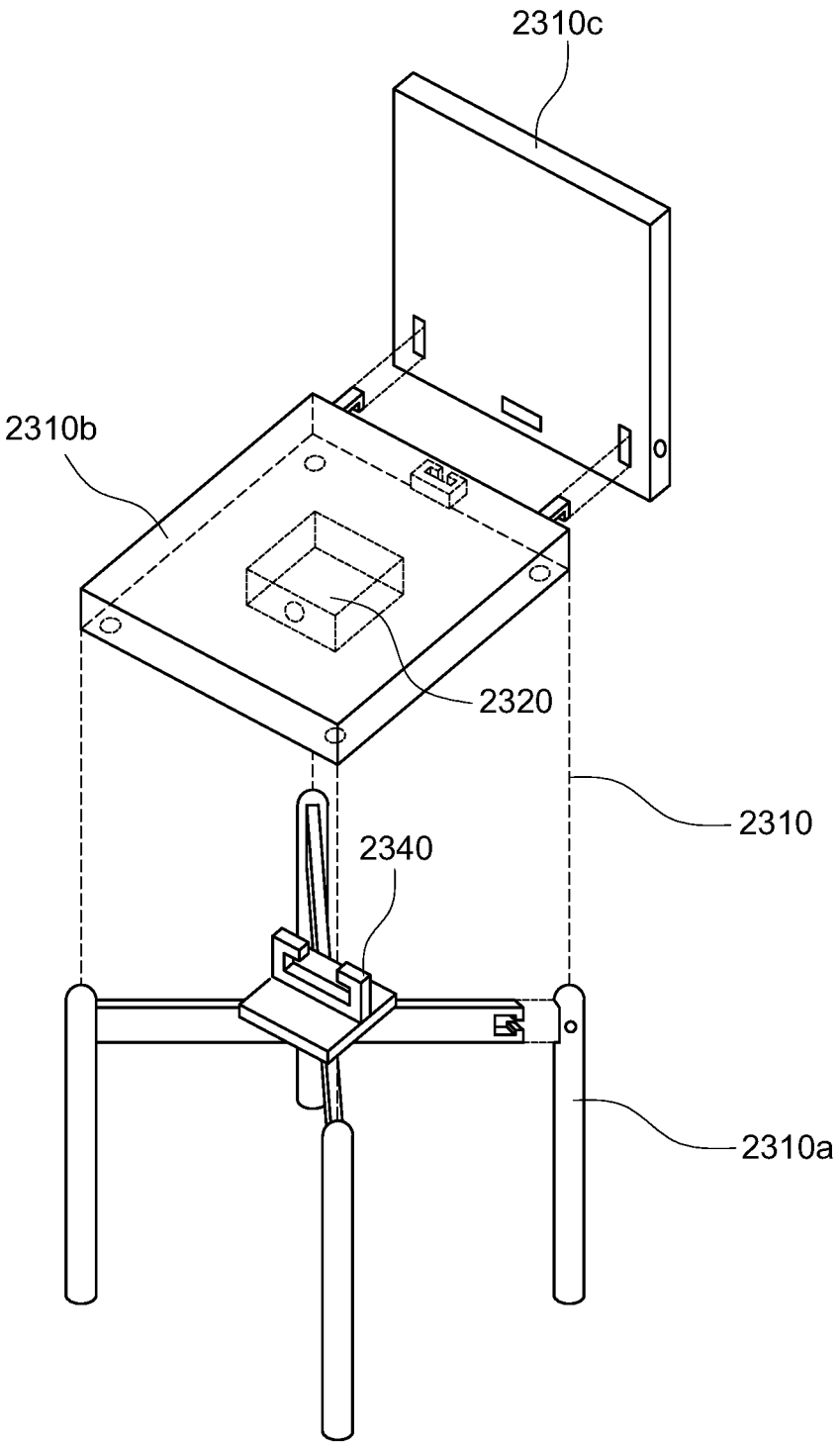

In FIG. 23, the chair 2310 has legs 2310(*a*), a sitting platform 2310(*b*) and a backrest 2310(*c*) all held together by the couplings of the invention, including coupling parts 2320 and 2340, in the manner already amply described.

Figure 24:
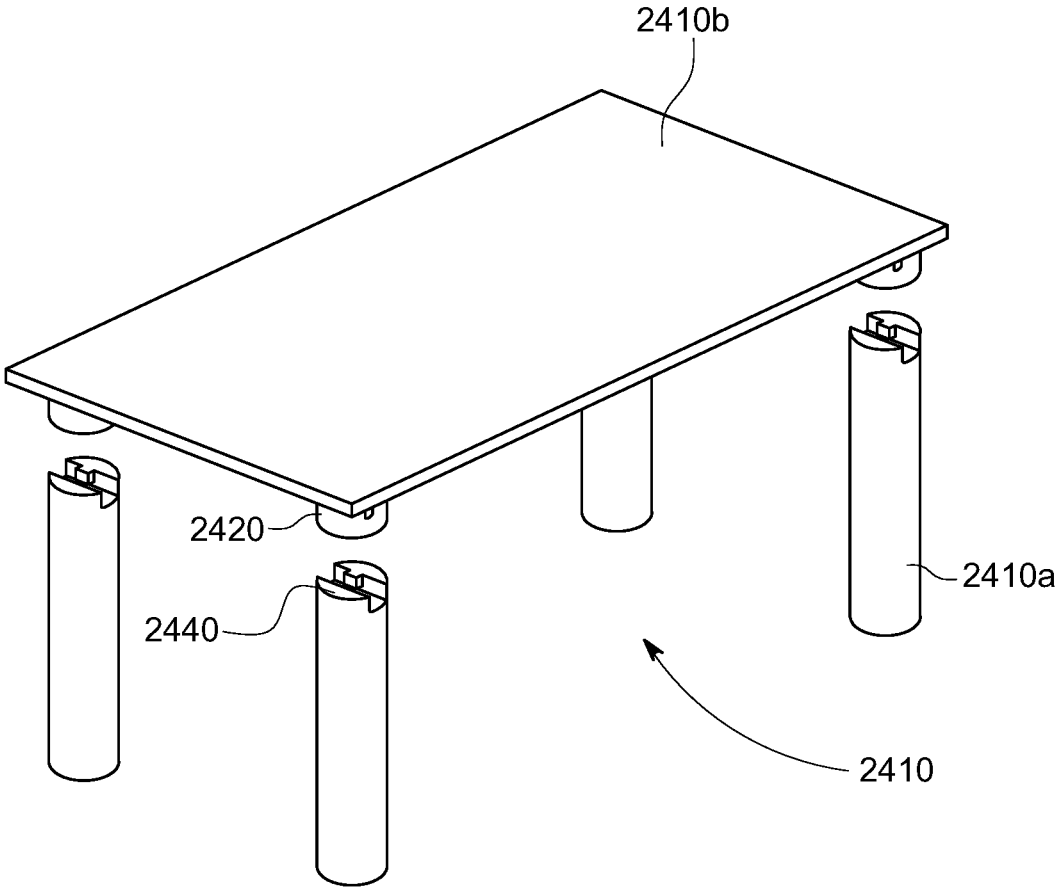
Figure 25:
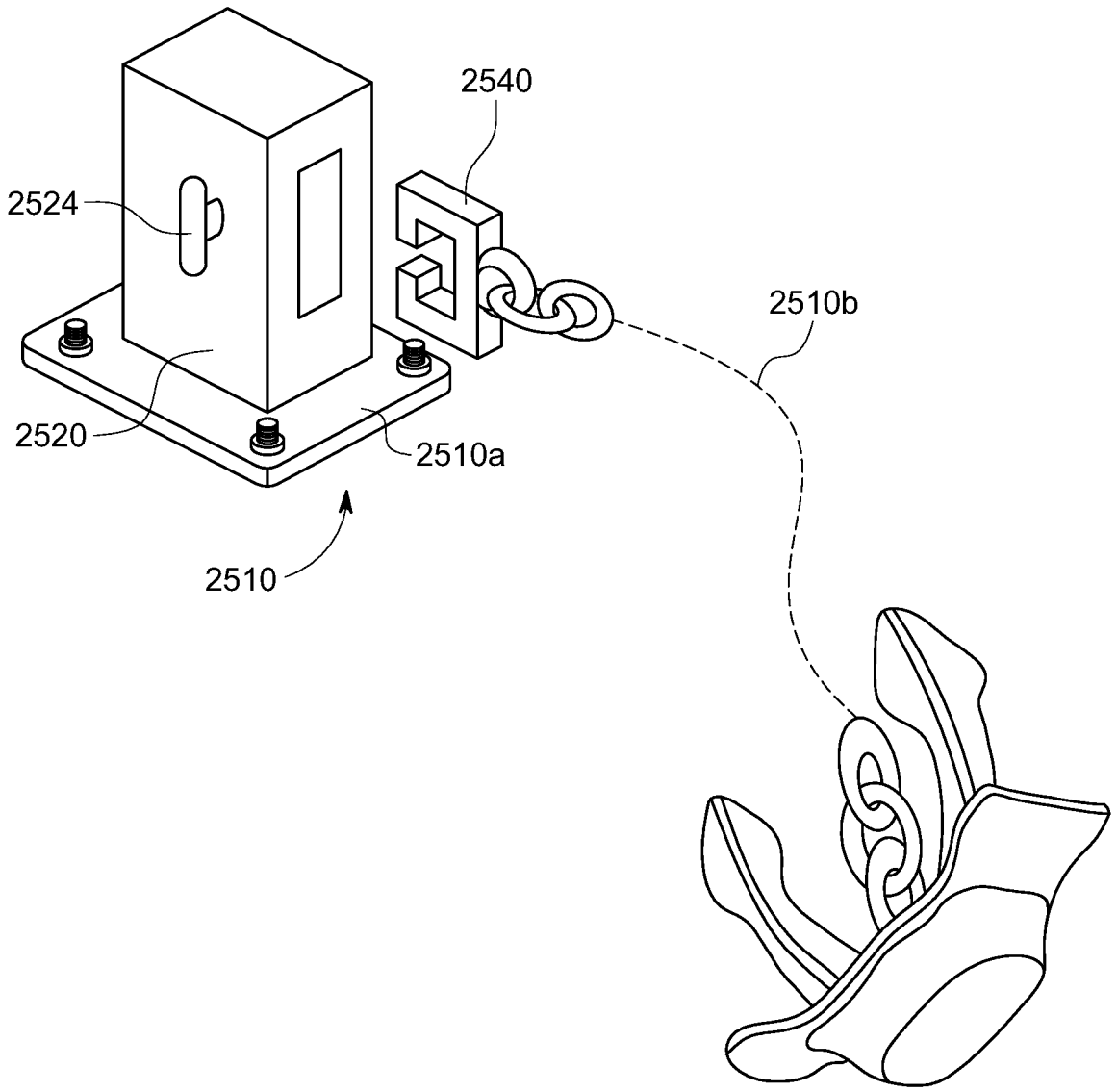
Figure 26:
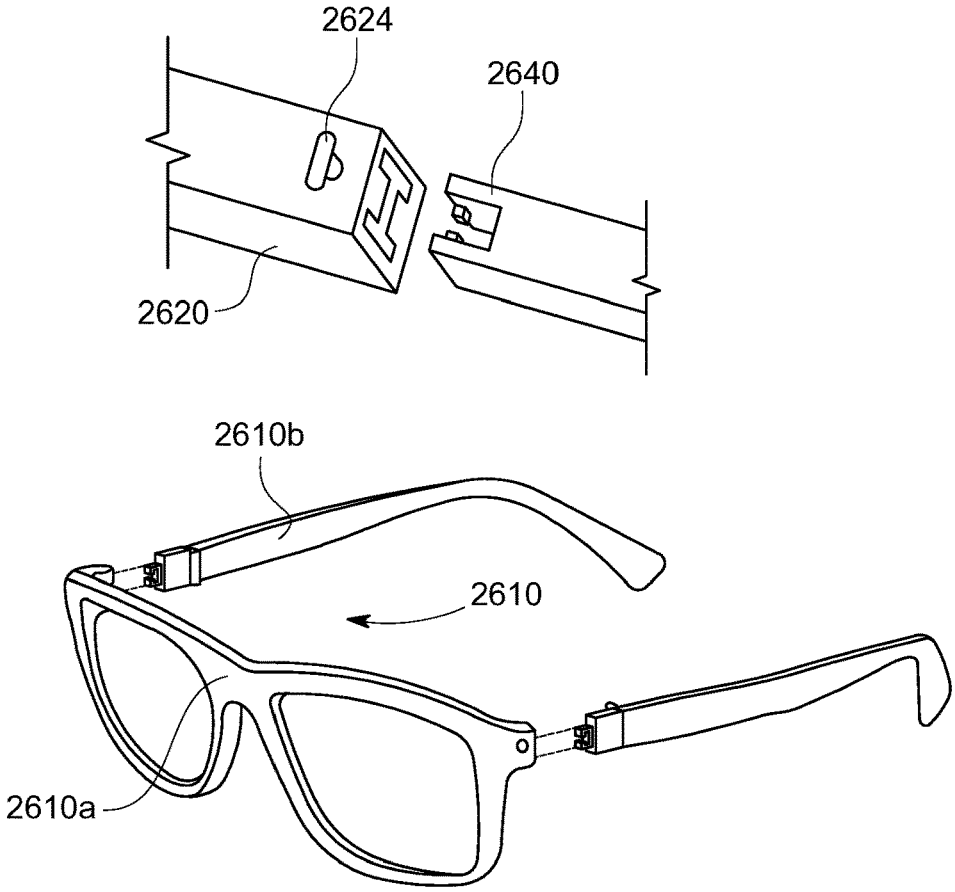

In FIG. 24, the table 2410 has a top 2410(*b*) and legs 2410(*a*) that are assembled and held together by the female and male couplings 2420 and 2440. Similarly, in FIG. 25, the ship's anchor assembly 2510 comprises a land based anchor 2510(*a*) and a crank and spool 2510(*b*), that utilize male and female couplings 2520 and 2540. Owing to the size and strength of these components the handle 2524 may be used to effect the locking and unlocking of the male coupling 2540. In the same vein, the glasses 2610 in FIG. 26 has a frame 2610(*a*) inter-assembled with its posts 2610(*b*) by the shown couplings 2620 and 2640, using the handle 2624.

Figure 27:
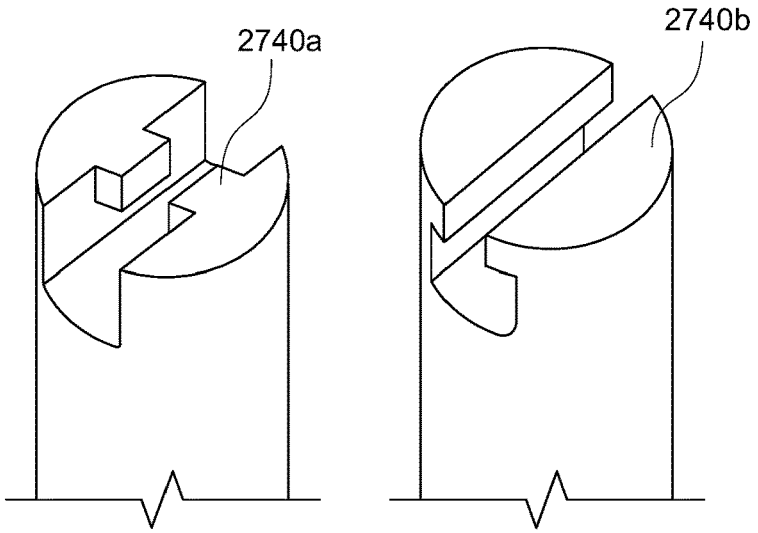
FIG. 27 illustrates a modified male coupling.
Figure 28A:
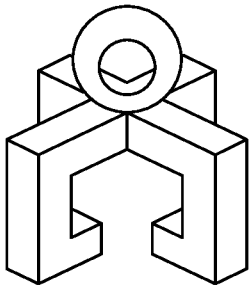
FIGS. 28A through 28D show modified male couplings.
Figure 28B:
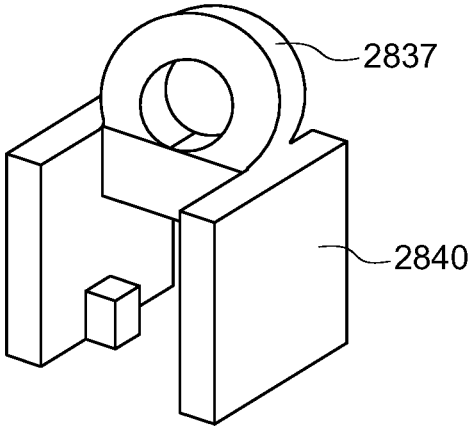
Figure 28C:
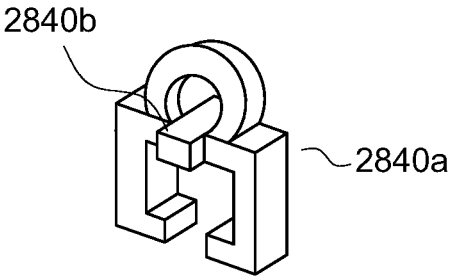
Figure 28D:
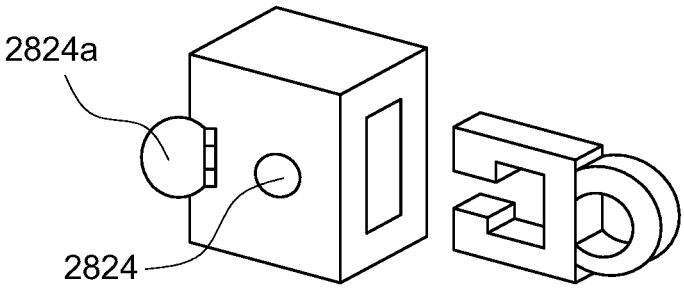

Further modifications to the couplings themselves are depicted in FIGS. 27 and 28A through 28D. In FIG. 27, the male couplings have either short action 2740(*a*) or longer action 2740(*b*) constructions. FIG. 28A shows an "X" shape male coupling while FIG. 28B shows an "H" shape male coupling 2840 with a loop 2837 for attachment to a jewelry (or non-jewelry) component. A similar male coupling 2840 (*a*) is shown in FIG. 28C, including a cross bar 2840(*b*). The female coupling of FIG. 28D includes a cover 2824(*a*) for the releasing button 2824, but may include other elements that block or prevent unintended actuation of the releasing button.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A miniaturized coupling for jewelry, comprising:

a male coupling and a female coupling, each of which is millimeter-sized or sub-millimeter-sized and each of which is attached to or suited to be attached to a respective jewelry component, the male coupling having a locking member configured to be inserted into the female coupling through an opening into an interior of the female coupling;

a connector located in the interior of the female coupling and biased by a spring to move along a movement axis, the connector being so constructed that when the locking member is inserted into the female coupling the connector initially moves laterally relative to the locking member to enable a portion of the locking member to move past the connector and thereafter enabling the connector to enter into an inner locking space defined in the locking member, thereby to releasably interlock the locking member with the connector, wherein said connector comprises a main body with a thickened portion that includes left and right inclined sliding surfaces that are configured to engage with said locking member of said male coupling to thereby cause said connector to move along said movement axis; and an actuating pin in the female coupling that extends from said main body of said connector and which is configured to move the connector to release the locking member and thereby disengage the male and female couplings from each other, the actuating pin being movable along said movement axis together with the connector, and the actuating pin having an outer surface accessible at an outer, flat surface of the female coupling, said outer surface of said actuating pin being configured to be actuated to move the connector along said movement axis.

2. The miniaturized coupling of claim 1, wherein the actuating pin is sized to be actuated using a releasing tool to move the actuating pin below the outer, flat surface of the female coupling.

3. The miniaturized coupling of claim 1, wherein the connector is resiliently-biased.

4. The miniaturized coupling of claim 1, wherein attachment and release of the female and male couplings is repeatable.

5. The miniaturized coupling of claim 1, wherein one or both of the male and female couplings comprise surface decorations and an overall shape that promotes the look and appearance of the coupling to blend into a corresponding look and appearance of the jewelry component.

6. The miniaturized coupling of claim 1, wherein upon mating of the male and female couplings the locking member is rendered virtually invisible.

7. The miniaturized coupling of claim 1, including a spring that is engaged with the locking element, to push it out of the female coupling upon actuation of the actuating pin.

8. The miniaturized coupling of claim 1, wherein the connector comprises an inclined surface that is engaged by the locking member when pushed into the interior of the female coupling.

9. The miniaturized coupling of claim 8, including a connector spring that biases the connector to resist moving laterally when the inclined surface is engaged by the locking member.

10. The miniaturized coupling of claim 8, wherein the female coupling comprises an outer housing, a base partially accommodating therein the connecter inside the outer housing and a cover over the base.

11. The miniaturized coupling of claim 1, wherein at least one of the male and female couplings has a cross sectional dimension of less than six millimeters.

12. The miniaturized coupling of claim 1, wherein the male coupling has a cross section of less than five millimeters.

13. The miniaturized coupling of claim 1, wherein the actuating pin is movable in a direction into the interior of the female coupling.

14. The miniaturized coupling of claim 1, in combination with a respective jewelry component attached to at least one of the female coupling and the male coupling.

15. The miniaturized coupling of claim 1, wherein the female coupling measures less than six mm in width, length and height dimensions.

16. The miniaturized coupling of claim 1, wherein the locking member comprises a pair of fingers, each with a respective distal end, in which distal ends are oriented toward each other, with a gap therebetween, said distal ends being configured to move past the connecter and to become locked inside the female coupling.

17. The connector of claim 1, wherein the outer surface of the actuating pin is aligned with the outer surface of the female coupling.

18. The connector of claim 1, wherein the actuating pin is movable in a direction into the interior of the female coupling.

19. The connector of claim 1, wherein the female coupling comprises an outer housing, a base partially accommodating therein the connecter inside the housing and a cover over the base.

20. A miniaturized coupling for jewelry, comprising:

a male coupling and a female coupling, each of which is millimeter-sized or sub-millimeter-sized and each of which is attached to or suited to be attached to a respective jewelry component, the male coupling having a locking member configured to be inserted into the female coupling through an opening into an interior of the female coupling;

a connector located in the interior of the female coupling, so constructed that when the locking member is inserted into the female coupling the connector initially moves and then is retained by the connector; and an actuating pin in the female coupling that is configured to move the connector to release the locking member and thereby disengage the male and female couplings from each other, the actuating pin having an outer surface accessible at an outer surface of the female coupling, said outer surface of said actuating pin being configured to be actuated to move the connector;

the locking member comprises a pair of fingers, each with a respective distal end, in which distal ends extend toward each other, with a gap therebetween, said distal ends being configured to move past the connector and to become locked inside the female coupling behind the connector.

21. The miniaturized coupling of claim 20, wherein the connector is resiliently-biased.

22. The miniaturized coupling of claim 20, wherein attachment and release of the female and male couplings is repeatable.

23. The miniaturized coupling of claim 20, wherein one or both of the male and female couplings comprise surface decorations and an overall shape that promotes the look and appearance of the coupling to blend into a corresponding look and appearance of the jewelry component.

24. The miniaturized coupling of claim 20, wherein upon mating of the male and female couplings the locking member is rendered virtually invisible.

25. The miniaturized coupling of claim 20, including a spring that is engaged with the locking element, to push it out of the female coupling upon actuation of the actuating pin.

26. The miniaturized coupling of claim 20, wherein the connector comprises an inclined surface that is engaged by the locking member when pushed into the interior of the female coupling.

27. The miniaturized coupling of claim 26, wherein the female coupling comprises an outer housing, a base partially accommodating therein the connecter inside the housing and a cover over the base.

28. The miniaturized coupling of claim 20, including a connector spring that biases the connector to resist moving laterally when the inclined surface is engaged by the locking member.

29. The miniaturized coupling of claim 20, wherein at least one of the male and female couplings has a cross sectional dimension of less than six millimeters.

30. The miniaturized coupling of claim 20, wherein the male coupling has a cross section of less than five millimeters.

31. The miniaturized coupling of claim 20, in combination with a respective jewelry component attached to at least one of the female coupling and the male coupling.

32. The miniaturized coupling of claim 20, wherein the female coupling measures less than six mm in width, length and height dimensions.

33. A jewelry assemblage, comprising:

a plurality of discrete jewelry components and a plurality of couplers enabling releasable interconnection of said jewelry components to each other in desired combinations and arrangements; each said coupler comprising:

a male coupling and female coupling, each of which has a cross-sectional shape measuring less than 6 millimeters and each of which is attached to respective jewelry components;

the male coupling is configured to be inserted into an opening in the female coupling to secure a connection, the connection beginning as the male coupling engages a snap connector located in an interior of the female coupling, so constructed that the snap connector moves to accommodate the male coupling, and upon being fully inserted, the snap connector resumes an original position locking within a gap formed in the male coupling and creating a secured, mechanically interlocked connection;

an actuating member inside the female coupling that extends to a point on an exterior of said female coupling, that can be manipulated via an external force applied to the actuating member by a release tool to release the connection; and wherein the male coupling comprises a pair of fingers, each with a respective distal end, in which distal ends are oriented toward each other, with the gap therebetween, said distal ends being configured to move past the snap connector and to become locked inside the female coupling.

* * * * *